US008580050B2

(12) United States Patent
Morita et al.

(10) Patent No.: US 8,580,050 B2
(45) Date of Patent: Nov. 12, 2013

(54) CARBURIZED MACHINE PARTS

(75) Inventors: Toshiyuki Morita, Aichi (JP); Tomoki Hanyuda, Aichi (JP)

(73) Assignee: Daido Steel Co., Ltd., Aichi (JP)

( * ) Notice: Subject to any disclaimer, the term of this patent is extended or adjusted under 35 U.S.C. 154(b) by 715 days.

(21) Appl. No.: 11/507,621

(22) Filed: Aug. 22, 2006

(65) Prior Publication Data

US 2007/0044866 A1 Mar. 1, 2007

(30) Foreign Application Priority Data

Aug. 24, 2005 (JP) ..... 2005-243324
Mar. 30, 2006 (JP) ..... 2006-096134

(51) Int. Cl.
*C22C 38/42* (2006.01)
*C23C 8/22* (2006.01)

(52) U.S. Cl.
USPC ..... 148/316; 148/330; 148/332; 148/335; 148/336; 420/106; 420/109

(58) Field of Classification Search
USPC ..... 148/400, 320, 330, 332–337; 420/8, 83, 420/89–93, 103–106, 108–110, 112, 420/119–121, 123, 124, 126, 127
See application file for complete search history.

(56) References Cited

U.S. PATENT DOCUMENTS 4,773,947 A * 9/1988 Shibata et al. ..... 148/221
6,475,305 B1 * 11/2002 Watari et al. ..... 148/320

* cited by examiner

*Primary Examiner* — Scott Kastler
*Assistant Examiner* — Vanessa Luk
(74) *Attorney, Agent, or Firm* — Posz Law Group, PLC

(57) ABSTRACT

Disclosed is a carburized machine part which is free from the problem of decreased strength at edge-shaped parts due to excess introduction of carbon. The machine part is produced by processing a case hardening steel of the alloy composition consisting essentially of, by weight %, C: 0.1-0.3%, Si: 0.5-3.0%, Mn: 0.3-3.0%, P: up to 0.03%, S: up to 0.03%, Cu: 0.01-1.00%, Ni: 0.01-3.00%, Cr: 0.3-1.0%, Al: up to 0.2% and N: up to 0.05% and the balance of Fe and inevitable impurities, and satisfying the following condition:

$$[Si\ \%]+[Ni\ \%]+Cu\ \%]-[Cr\ \%]>0.5$$

and carburizing by vacuum carburization.

4 Claims, 3 Drawing Sheets

A

[Carburization: 30 min.+ Diffusion: 30 min.] × once

B

[Carburization: 20 sec.+ Diffusion: 15 sec.] × 9 times

CARBURIZED MACHINE PARTS

BACKGROUND OF THE INVENTION

1. Field in the Industry

The present invention concerns a case hardening steel which gives carburized machine parts having appropriate carbon contents by suppressing excess carburization. The invention concerns also carburized machine parts produced with this case hardening steel.

2. Prior Art

Recently, for production of machine parts with steel by processing the steel to form, for example, a gear, and carburizing the shaped green, vacuum-carburization has been often used instead of conventional gas-carburization. This is because the vacuum-carburization has the following advantages over the gas-carburization:

1) grain boundary oxidation can be avoided, because no oxidation of the material occurs during the carburization carried out under vacuum, and thus, the strength of the product is secured;
2) high temperature carburization can be easily practiced due to the structure of the device for the carburization, and therefore, rapid carburization is possible; and
3) running cost for the carburization is low since the amount of carburizing gas is small.

On the other hand, surface carbon contents of the carburized products tend to be influenced by the shape of the parts, namely, excess carbon may be introduced into the edge-shaped parts, and as the results, local decrease in the strength may be observed due to increase of the amount of the residual austenite and formation of carbides. For the remedy of this disadvantage there has been proposed to remove the excess carbon by carrying out decarburization after the carburization (Japanese patent disclosures Nos. 2003-171756 and 2004-115893). The decarburization runs, however, risk of losing the advantages of vacuum carburization due to not only increase of the process steps but also decrease of the strength caused by grain boundary oxidation during the decarburization.

There is a problem in the carburized products that strain occurs in the parts at quenching step of the carburization, and the strain may cause destruction during use of the machine parts. For the purpose of preventing this it has been proposed to choose a certain alloy composition which may form ferrite in the non-carburized parts so as to convert the structure to ferrite-martensite binary phase (Japanese patent disclosure No. 09-111408). The technology, however, is not helpful to the goal of increasing the strength of the carburized machine parts.

In regard to a case hardening steel with increased strength there was disclosed a technology of making the depth of oxidation at grain boundaries small by dispersing fine TiC so as to enjoy the resulting increase of strength (Japanese patent disclosure No. 2004-3000550). Also, a case hardening steel with increased resistance to temper softening by choosing alloy composition to increase the strength of the tooth flanks such as pitching resistance and abrasion resistance (Japanese patent disclosure No. 2003-231943). These technologies, however, contain no consideration for countermeasure to excess carburization at the edge-shaped parts.

The inventors have made research to seek a way to solve the problem of excess introduction of carbon at the edge-shaped parts in vacuum carburization. Investigation of the mechanism of introducing carbon in the vacuum carburization revealed the fact that carbon is accumulated by formation of carbides during the carbon-introducing step in which carbon is supplied to the surfaces of the machine parts, and then, the carbides decompose in the diffusion step to release carbon, which is supplied to the matrix by being dissolved therein. The inventors considered that the excess carburization in the edge-shaped parts in the vacuum carburization is caused by denser formation of carbides in the edge-shaped parts than in the plane surfaces, and thus, much more carbides accumulate. If, however, carbon contents at whole the surface of the parts are lowered to avoid precipitation of carbides, the carbon contents at the plane surfaces will be extremely low and thus, the hardness and the strength of the carburized machine parts decrease.

Based on the above knowledge, it was found that the highest carbon content in the surfaces of the carburized parts at which no carbide precipitates is 1.1%. On the other hand, the lowest carbon content at which the surfaces of the carburized machine parts have sufficient hardness and resulting sufficient strength was found to be 0.6%.

The inventors further sought alloy composition which may make it easy to control the carbon content in the surface layer of the machine parts to be carburized. This is based on the idea to make, of the carbon to be introduced by carburization, the portion that coming by way of carbides relatively small, and the rest, the portion that coming by way of direct dissolution relatively high, and to realize this by choosing the alloy composition. As the results of the inventors' research on the effect of alloying components it was found that Si and Ni suppress formation of the carbides during carburization, that Cu behaves like these elements, that Cr enhances formation of the carbides, and that Mn and Mo have little influence.

SUMMARY OF THE INVENTION

The object of the present invention is to provide, on the basis of the above-described knowledge by the inventors, a case hardening steel which gives carburized machine parts with smaller fluctuation of surface carbon content treated even by vacuum carburization, and to provide carburized machine parts, by using this case hardening steel, with suppressed excess carburization at the edge-shaped parts and no problem of decreased strength due to the excess carburization.

The machine part with smaller fluctuation of carbon content according to the present invention is a carburized machine part produced by processing a case hardening steel of the following alloy composition consisting essentially of, by weight %, C: 0.1-0.3%, Si: 0.5-3.0%, Mn: 0.3-3.0%, P: up to 0.03%, S: up to 0.03%, Cu: 0.01-1.00%, Ni: 0.01-3.00%, Cr: 0.3-1.0%, Al: up to 0.2% and N: up to 0.05% and the balance of Fe and inevitable impurities, and satisfying the following condition: [Si %]+[Ni %]+Cu %]−[Cr %]>0.5 to form a green and carburizing the green by vacuum carburization.

DETAILED EXPLANATION OF THE PREFERRED EMBODIMENTS

In the carburized machine parts according to the invention, because the surface carbon contents in the carburized parts are at highest 1.1%, amount of carbides formed is small, and therefore, no locally high carbon content due to decomposition of the carbides appears and the resilience of the edge-shaped parts will not be low. Further, the surface carbon contents in the carburized machine parts are at lowest 0.6%, and thus, no parts of low strength due to insufficient carburization.

The machine part obtained by carburizing a shaped article of the above described case hardening steel can be understood as a carburized product in which, when a sphere of diameter 1 mm on the surface of the part is supposed, the surface carbon content in the portion where the quotient given by dividing the volume of the steel in the sphere with the surface area is 0.7 mm or more is up to 1.1%, and the surface carbon content in the portion where the quotient is 0.3 mm or less is at least 0.6%. This idea can be more easily understood when reference is made to FIGS. 1A and 1B.

Figure 1:
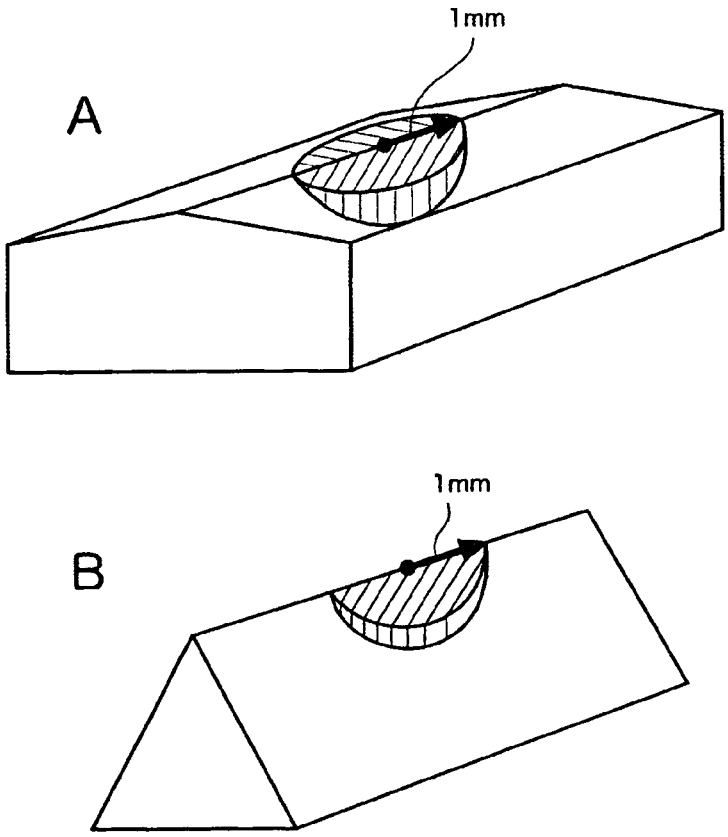
FIG. 1 conceptually illustrates the condition of carbon contents in the surfaces of the carburized machine parts according to the present invention, in which A represents a part other than edge-shape, and B, an edge-shaped part.

FIG. 1A illustrates the part of the carburized machine part, in which, when a sphere of diameter 1 mm on the surface of the part is supposed, the quotient given by dividing the volume of the steel in the supposed sphere with the surface area is 0.7 mm or more. This Figure represents the case where the corner angle at the point shown in the Figure is 170° or more, i.e., the planar, not edge-shaped part. On the other hand, FIG. 1B illustrates the part of the carburized machine part, in which, when a sphere of diameter 1 mm on the surface of the part is supposed, the quotient given by dividing the volume of the steel in the supposed sphere with the surface area is 0.3 mm or less. This Figure represents the case where the corner angle at the point shown in the Figure is 60° or less, i.e., the edge-shaped part. It is essential that the surface carbon content is, in the former case, up to 1.1%, and in the latter case, at least 0.6%.

Production of the carburized machine part according to the present invention may be done, as far as the carburization is carried out as a vacuum carburization, by using various hydrocarbon gases such as acetylene, ethylene and propane, as the carburizing gas. Carburizing pattern may be chosen without limitation. Those skilled in the art could decide appropriate conditions for vacuum carburization with reference to the working examples shown below.

The case hardening steel as the material for the carburized machine parts according to the invention may contain, in addition to the above-described basic alloy components, at least one group of the optional alloying elements below:

1) Mo: up to 2.0%,
2) one or both of Nb: up to 0.20% and Ti: up to 0.20%,
3) B: up to 0.01%, and
4) one or more of Pb: 0.01-0.20%, Bi: 0.01-0.10% and Ca: 0.0003-0.0100%.

The following explains the basic alloy composition of the case hardening steel of the present invention. The carbon content range (0.1-0.3%) mentioned above is a suitable range for securing strength necessary for machine parts. Manganese, which is added at steelmaking as the deoxidizing agent, gives little influence on formation of the carbides and therefore, the content can be chosen from a wide range (0.3-3.0%). Phosphor and sulfur are impurities and not preferable for mechanical properties of the product machine parts, and therefore, the contents should be as low as possible. The above values (both 0.03%) are the permissible upper limits.

Silicon (0.4-3.0%), nickel (0.01-3.00%) and copper (0.01-1.00%) are the components which suppress formation of the carbides. They must be added in the amounts of the above lower limits or more and such amounts that the total thereof minus the amount of chromium exceeds 0.5. Too much addition will, however, lowers hot workability of the steel, and thus, the above upper limits are set.

Cr: 0.3-1.0%

As noted above, Cr is a component enhancing formation of the carbides, and therefore, should not exist in a large amount in the case hardening steel of the invention. The above 1.0% is the upper limit of Cr-content only possible in the case where the components suppressing formation of the carbides are contained in sufficient amounts. However, extremely low Cr-content causes decrease in hardenability of the steel, which results in dissatisfactory mechanical properties of the product machine parts, and therefore, the lower limit, 0.3%, is set.

Al: up to 0.20%

Aluminum, which is added at the steelmaking as a deoxidizing agent, if added too much, may damage the workability of the steel, and thus, a suitable addition amount should be chosen in the range up to 0.20%. Al also has the effect of preventing coarsening crystal grain, and in case where this effect is desirable, at least 0.005% or more of Al is added.

N: 0.001-0.050%

Nitrogen has the effect of preventing coarsening crystal grain. It is necessary that N exists in the steel in an amount of at least 0.001%. Because this effect saturates at the content of about 0.050%, and there is no use of adding excess N in an amount exceeding this upper limit.

$$[Si\ \%]+[Ni\ \%]+[cu\ \%]-[Cr\ \%]>0.5$$

As noted above, Si, Ni and Cu suppress formation of the carbides, while Cr enhances. It is possible to realize suppression of carbide formation at the edge-shaped parts aimed at by the present invention by balancing the effect of the former three and the effect of the latter one. This formula was introduced from the data of the working examples described below.

The following explains the alloying elements which may be added optionally to the case hardening steel of the invention.

Mo: up to 2.0%

Molybdenum may be added for the purpose of enhancing the hardenability and resistance to temper-softening. Too much addition will damage the workability of the steel, and therefore, a suitable addition amount up to 2.0% must be chosen.

One or both of Nb: up to 0.20% and Ti: up to 0.20%

Addition of these elements is useful for suppressing growth of crystal grain at the carburizing and maintaining the whole grain structure. Too large amount or amounts affect the workability and thus, addition must be in the amount up to the above limits.

B: up to 0.01%

Boron is useful for enhancing hardenability of the steel, and is added if desired. Because much boron is harmful to workability of the steel, addition amount should be up to 0.01%.

One or more of Pb: 0.01-0.20%, Bi: 0.01-0.10% and Ca: 0.0003-0.0100%

These elements are useful for the purpose of improving machinability of the product machine parts. If the addition amount is too large, the resilience of the steel will be affected. The addition amount or amounts should be up to the above limits.

Either in the alloy compositions of the basic one or the alloy composition with the optional alloying element or elements of the case hardening steel as the material for the carburized machine parts, it is preferable to control the amounts of the important elements which tend to be contained in the steel depending on the choice of the raw materials. Those important impurities are Sn, As and Sb, which make the steel brittle. Care should be made to control their contents so that they satisfy the condition: [Sn %]+[As %]+[Sb %]<0.3.

EXAMPLES

Testing Examples

Using the three kinds of the steel of the alloy composition (weight %, balance Fe) shown in Table 1, samples of machine parts having edge-shaped parts were prepared.

TABLE 1

| | C | Si | Mn | Cu | Ni | Cr | Si + Ni + Cu − Cr |
|---|---|---|---|---|---|---|---|
| High-Si | 0.2 | 1.5 | 0.8 | 0.1 | 0.05 | 0.7 | 0.95 |
| SCM420 | 0.2 | 0.2 | 0.8 | 0.1 | 0.05 | 1.0 | −0.65 |
| SCM420 High-Cr | 0.2 | 0.2 | 0.8 | 0.1 | 0.05 | 4.9 | −4.55 |

These samples were subjected to carburization and heat treatment under the following conditions:

1) Soaking at 950° C. for 30 minutes
2) Carburization at 950° C. for 30 minutes
3) Diffusion Treatment at 950° C. for 30 minutes
4) Maintaining at 850° C. for 30 minutes
5) Quenching
6) Tempering at 180° C. for 1 hour The condition for carburization: propane gas atmosphere at 200 Pa, and the condition for the diffusion treatment: under vacuum (5 Pa or less).

Figure 2:
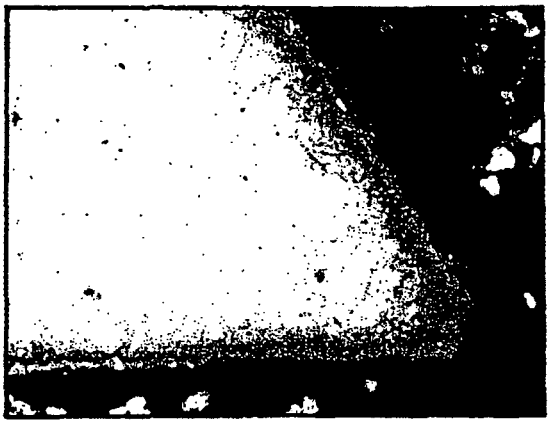
FIG. 2 is a microphotograph of a specimen prepared in the working example of the invention showing formation of carbides in a sample having an edge-shaped part after vacuum carburization and heat treatment, wherein the case hardened steel used is a high-Si steel.
Figure 3:
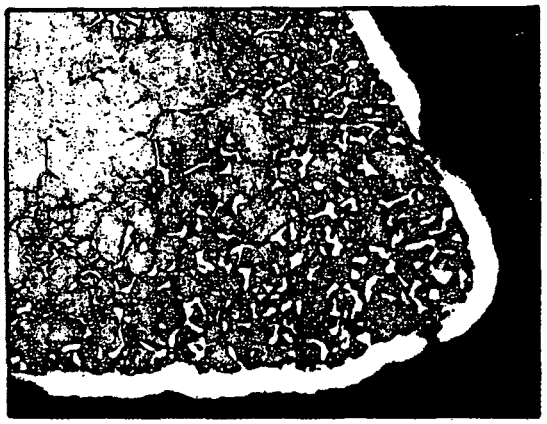
FIG. 3 is a microphotograph similar to FIG. 2, wherein the case hardened steel is SCM420 (Cr: 1.0%)
Figure 4:
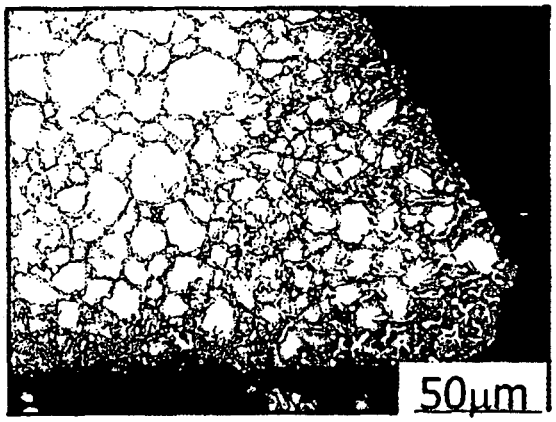
FIG. 4 is also a microphotograph similar to FIG. 2, wherein the case hardened steel is high-Cr SCM420 (Cr: 4.9%)

Edge-shaped parts of the carburized and heat-treated three samples were abraded and the exposed surfaces were etched with nital solution. The surfaces were observed with a metallographic microscope, which are shown in FIGS. 2 to 4. The white area in these photos shows presence of the carbides. In the photo (FIG. 2) of the high-Si steel having a high value of [Si %]+[Ni %]+[Cu %]−[Cr %] the carbides are not so clearly observed. On the other hand, in the photo (FIG. 3) of the SCM420 steel having a minus value of the above formula existence of the carbides is clear, and in the photo (FIG. 4) of the high-Cr steel significant formation of the carbides is observed.

Working Examples and Control Examples

Figure 5:
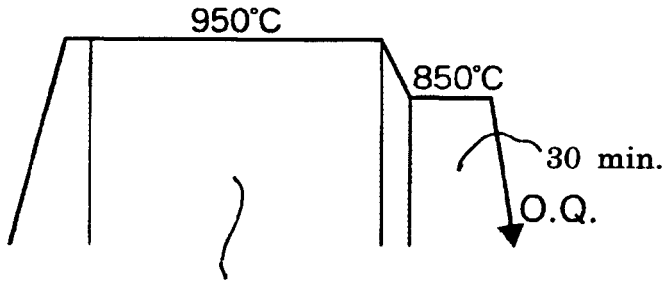
FIG. 5A is a carburizing pattern in which carburizing gas was introduced only once.
FIG. 5B is a carburizing pattern in which carburizing gas was introduced in a pulse-wise manner with several portions.
Figure 5:
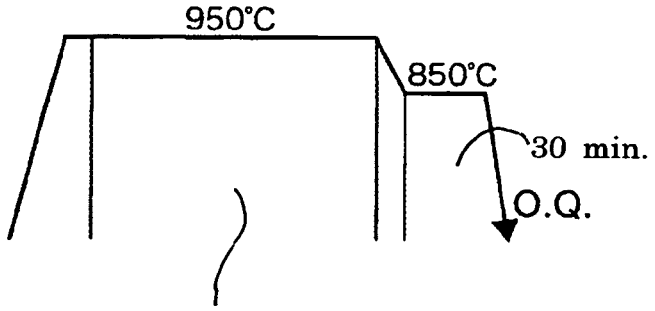

The steels having the compositions shown in Table 2 were used for carburization. From each steel test pieces having edges of corner angle 60° were prepared. The samples were subjected to carburization of the pattern shown in FIG. 5A (pattern "A"), in which the carburizing gas was introduced only once, or the pattern shown in FIG. 5B (pattern "B"), in which the carburizing gas was introduced pulse-wise manner with several portions. Carburization conditions are as follows.

Atmosphere: acetylene or propane gas

Pressure: carburizing step 200 Pa, diffusion step 5 Pa or less.

Surface carbon contents of the obtained carburized products were determined. Determination was made on the plane parts (corresponding to the parts where the quotient given by dividing the volume of the steel in a sphere of diameter 1 mm with the surface area is 0.7 mm or more) and edge-shaped parts (corresponding to the parts where the quotient given by dividing the volume of the steel in a sphere of diameter 1 mm with the surface area is 0.3 mm or less).

Then, test gears were prepared from the testing samples by machining, which were carburized and heat-treated under the same conditions as those of the testing examples. The test gears were subjected to measurement of $10^7$ cycle-strength. The measuring conditions are the same as those of the testing examples. The carburization conditions, carbon contents at the plane and the edge-shaped parts, and the fatigue strength are shown in Table 3.

Figure 6:
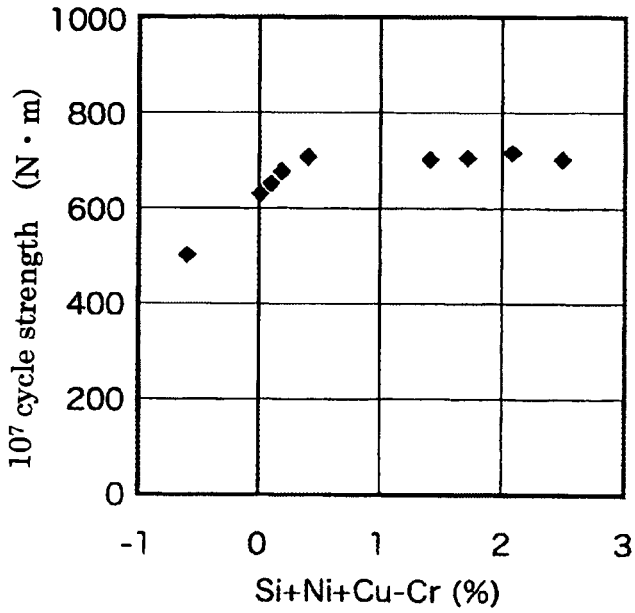
FIG. 6 is a graph of the data of the working examples according to the invention showing the relation between the values of the formula [Si %]+[Ni %]+[Cu %]-[Cr %] and $10^7$ cycle-strength.

By plotting the relation between the values of the formula [Si %]+[Ni %]+[Cu %]−[Cr %] and the $10^7$ cycle-strengths of the working examples and the control examples the graph of FIG. 6 was obtained. From this graph it is understood that the $10^7$ cycle-strength becomes high and nearly constant where the value of the above formula exceeds 0.5 or so.

TABLE 2

| | Weight %, Balance Fe | | | | | | | | | | | | |
|---|---|---|---|---|---|---|---|---|---|---|---|---|---|
| No. | C | Si | Mn | P | S | Cu | Ni | Cr | Mo | Al | N | others | Si + Cu + Ni − Cr |
| | Working Examples | | | | | | | | | | | | |
| 1 | 0.15 | 2.50 | 2.50 | 0.025 | 0.025 | 0.80 | 2.50 | 1.00 | 1.70 | 0.010 | 0.009 | | 4.80 |
| 2 | 0.25 | 0.80 | 0.40 | 0.002 | 0.003 | 0.01 | 0.30 | 0.30 | — | 0.170 | 0.014 | | 0.52 |
| 3 | 0.10 | 1.42 | 2.81 | 0.014 | 0.030 | 0.06 | 0.55 | 0.65 | 1.01 | 0.082 | 0.034 | | 1.38 |
| 4 | 0.12 | 0.85 | 0.85 | 0.013 | 0.026 | 0.43 | 1.58 | 0.67 | 0.51 | 0.199 | 0.041 | | 2.19 |
| 5 | 0.20 | 2.27 | 2.55 | 0.002 | 0.030 | 0.60 | 1.67 | 0.74 | 0.01 | 0.022 | 0.019 | | 3.80 |
| 6 | 0.25 | 1.31 | 1.35 | 0.002 | 0.009 | 0.01 | 0.38 | 0.76 | 0.33 | 0.020 | 0.007 | | 0.94 |
| 7 | 0.25 | 1.93 | 1.10 | 0.012 | 0.013 | 0.06 | 0.27 | 0.54 | 0.12 | 0.047 | 0.024 | | 1.72 |
| 8 | 0.21 | 1.57 | 1.49 | 0.025 | 0.010 | 0.03 | 0.07 | 0.37 | 0.18 | 0.049 | 0.029 | | 1.30 |
| 9 | 0.23 | 1.38 | 0.91 | 0.013 | 0.009 | 0.18 | 0.14 | 0.92 | 0.15 | 0.043 | 0.017 | | 0.73 |
| 10 | 0.20 | 0.84 | 1.44 | 0.017 | 0.020 | 0.07 | 0.43 | 0.52 | 0.24 | 0.049 | 0.006 | | 0.82 |
| 11 | 0.20 | 1.47 | 0.52 | 0.005 | 0.008 | 0.03 | 0.09 | 0.89 | 0.21 | 0.005 | 0.042 | | 0.70 |
| 12 | 0.23 | 0.51 | 0.89 | 0.006 | 0.019 | 0.22 | 0.20 | 0.42 | 0.08 | 0.013 | 0.013 | | 0.51 |

TABLE 2-continued

| No. | C | Si | Mn | P | S | Cu | Ni | Cr | Mo | Al | N | others | Si + Cu + Ni − Cr |
|---|---|---|---|---|---|---|---|---|---|---|---|---|---|
| Weight %, Balance Fe | | | | | | | | | | | | | |
| 13 | 0.24 | 1.84 | 0.84 | 0.025 | 0.018 | 0.10 | 0.17 | 0.68 | 0.17 | 0.006 | 0.019 | Nb 0.1 | 1.43 |
| 14 | 0.22 | 1.45 | 0.70 | 0.009 | 0.014 | 0.08 | 0.01 | 0.84 | 0.23 | 0.031 | 0.032 | Ti 0.18 | 0.70 |
| 15 | 0.21 | 1.26 | 0.58 | 0.002 | 0.013 | 0.14 | 0.17 | 0.48 | 0.23 | 0.008 | 0.038 | B 0.0012 | 1.09 |
| 16 | 0.17 | 1.63 | 0.42 | 0.017 | 0.022 | 0.47 | 0.29 | 0.54 | 0.20 | 0.005 | 0.012 | Pb 0.1 | 1.85 |
| 17 | 0.23 | 1.54 | 1.80 | 0.003 | 0.006 | 0.50 | 1.71 | 0.46 | 0.16 | 0.008 | 0.006 | Bi 0.05 | 3.29 |
| 18 | 0.22 | 1.87 | 0.62 | 0.007 | 0.025 | 0.10 | 0.91 | 0.72 | 0.16 | 0.006 | 0.018 | Ca 0.005 | 2.16 |
| 19 | 0.22 | 1.45 | 0.70 | 0.009 | 0.014 | 0.08 | 0.01 | 0.84 | 0.23 | 0.031 | 0.031 | Ti 0.18 | 0.70 |
| 20 | 0.23 | 1.55 | 2.36 | 0.002 | 0.028 | 0.38 | 1.23 | 0.74 | 0.25 | 0.005 | 0.007 | Sn 0.09<br>As 0.1<br>Sb 0.1 | 2.42 |
| Control Examples | | | | | | | | | | | | | |
| 1 | 0.20 | 0.53 | 0.75 | 0.012 | 0.017 | 0.02 | 0.02 | 0.36 | 0.22 | 0.037 | 0.032 | | 0.21 |
| 2 | 0.19 | 0.54 | 0.92 | 0.003 | 0.025 | 0.16 | 0.12 | 0.99 | 0.26 | 0.043 | 0.024 | | −0.17 |
| 3 | 0.19 | 0.70 | 0.76 | 0.022 | 0.013 | 0.03 | 0.07 | 0.88 | 0.33 | 0.017 | 0.016 | | −0.08 |
| 4 | 0.24 | 0.53 | 1.38 | 0.015 | 0.029 | 0.19 | 0.31 | 0.83 | 0.11 | 0.045 | 0.017 | | 0.20 |

TABLE 3

| Run No. | Carburization Condition: Carburizing Gas | Carburization Condition: Carburizing Pattern | Carbon Content(%): Planer Part | Carbon Content(%): Edge-shaped Part | Strength (MPa) |
|---|---|---|---|---|---|
| Working Examples | | | | | |
| 1 | acetylene | A | 0.74 | 1.01 | 680 |
| 2 | propane | A | 0.69 | 1.05 | 704 |
| 3 | acetylene | A | 0.64 | 0.90 | 695 |
| 4 | propane | A | 0.63 | 0.98 | 723 |
| 5 | acetylene | B | 0.81 | 1.07 | 715 |
| 6 | propane | A | 0.62 | 0.98 | 676 |
| 10 | propane | A | 0.69 | 0.96 | 706 |
| 11 | acetylene | A | 0.75 | 1.08 | 675 |
| 12 | propane | A | 0.81 | 1.08 | 707 |
| 13 | acetylene | B | 0.80 | 1.04 | 697 |
| 14 | propane | B | 0.82 | 1.02 | 725 |
| 15 | acetylene | B | 0.81 | 1.04 | 694 |
| 16 | propane | B | 0.74 | 0.92 | 696 |
| 17 | acetylene | A | 0.74 | 0.92 | 686 |
| 18 | propane | A | 0.78 | 1.02 | 691 |
| 20 | propane | A | 0.70 | 0.99 | 713 |
| Control Examples | | | | | |
| 1 | acetylene | B | 0.55 | 0.95 | 661 |
| 2 | propane | B | 0.64 | 1.24 | 672 |
| 3 | acetylene | B | 0.80 | 1.30 | 585 |
| 4 | propane | B | 0.80 | 1.37 | 630 |

We claim:

1. A carburized machine part produced by processing a case hardening steel of the following alloy composition consisting of, by weight %, C: 0.1-0.3%,
Si: 0.5-3.0%,
Mn: 0.3-3.0%,
P: up to 0.03%,
S: up to 0.03%,
Cu: 0.01-1.00%,
Ni: 0.01-3.00%,
Cr: 0.3-1.0%,
one or more of Pb: 0.01-0.20%, Bi: 0.01-0.10%, and Ca: 0.0003-0.0100%,
Mo: up to 2.0%,
one or both of Nb: up to 0.20% and Ti: up to 0.20%,
B: up to 0.01%,
Al: up to 0.2%,
N: up to 0.05%,
balance of Fe and inevitable impurities, and
satisfying the following condition: [Si %]+[Ni %]+[Cu %]-[Cr %]>0.5 to form a green and carburizing the green by vacuum carburization,
wherein the content of carbon in edge-shaped surface portions of the carburized machine part is at least 0.6% and the content of carbon in planar surface portions of the carburized machine part is up to 1.1%.

2. The carburized machine part according to claim 1 consisting of 0.1-0.25% by weight of carbon.

3. A carburized machine part produced by processing a case hardening steel of the following alloy composition consisting of, by weight %, C: 0.1-0.3%,
Si: 0.5-3.0%,
Mn: 0.3-3.0%,
P: up to 0.03%,
S: up to 0.03%,
Cu: 0.01-1.00%,
Ni: 0.01-3.00%,
Cr: 0.3-1.0%,
Mo: up to 2.0%,
one or both of Nb: up to 0.20% and Ti: up to 0.20%,
B: up to 0.01%,
Al: up to 0.2%,
N: up to 0.05%,
balance of Fe and inevitable impurities,
and satisfying the following condition: [Si %]+[Ni %]+[Cu %]-[Cr %]>0.5 to form a green and carburizing the green by vacuum carburization,
wherein contents of impurities of the case hardening steel used satisfies the following condition: [Sn %]+[As %]+[Sb %]<0.3, and
wherein the content of carbon in edge-shaped surface portions of the carburized machine part is at least 0.6% and the content of carbon in planar surface portions of the carburized machine part is up to 1.1%.

4. The carburized machine part according to claim 3 consisting of 0.1-0.25% by weight of carbon.

* * * * *